US007435907B2

(12) United States Patent
Somers

(10) Patent No.: US 7,435,907 B2
(45) Date of Patent: Oct. 14, 2008

(54) MIRRORED ARC CONDUCTING PAIR

(75) Inventor: Steve Somers, Chino Hills, CA (US)

(73) Assignee: RGB Systems, Inc., Anaheim, CA (US)

( * ) Notice: Subject to any disclaimer, the term of this patent is extended or adjusted under 35 U.S.C. 154(b) by 0 days.

(21) Appl. No.: 11/557,046

(22) Filed: Nov. 6, 2006

(65) Prior Publication Data

US 2007/0119609 A1 May 31, 2007

Related U.S. Application Data

(60) Provisional application No. 60/734,796, filed on Nov. 7, 2005.

(51) Int. Cl.
*H01B 3/30* (2006.01)

(52) U.S. Cl. ..... 174/102 SP; 174/114 R

(58) Field of Classification Search ..... 174/102 SP, 174/114 R; 333/1; 178/45
See application file for complete search history.

(56) References Cited

U.S. PATENT DOCUMENTS 1,996,186 A * 4/1935 Affel ..... 174/32
2,669,603 A * 2/1954 Prache ..... 178/45
2,847,499 A * 8/1958 Peterson ..... 174/107
3,082,387 A * 3/1963 Monelli et al. ..... 333/1

FOREIGN PATENT DOCUMENTS

JP 02-249303 * 10/1999

* cited by examiner

*Primary Examiner*—Chau N Nguyen
(74) *Attorney, Agent, or Firm*—The Hecker Law Group, PLC

(57) ABSTRACT

A mirrored arc geometrical arrangement of two conductors configured to perform similar functions as a traditional twisted pair of wires is presented. The mirrored arc conductor pair occupies the same physical space required by prior art twisted pair cable designs. Each conductor pair includes two inward-facing arc shaped conductors placed within a dielectric material. Each arc shaped conductor may be constructed from thin foil strips of a conducting metal or from a group of separate bare metal conductors which are placed side by side in intimate contact so as to effectively create the same mirrored arc geometry. The conductor pairs may subsequently be bundled to create a data network cable bundle.

5 Claims, 4 Drawing Sheets

MIRRORED ARC CONDUCTING PAIR

CROSS REFERENCE TO RELATED APPLICATIONS

This application claims priority from U.S. Provisional Patent Application Ser. No. 60/734,796, filed on Nov. 7, 2005, specification and drawings of which are herein incorporated by reference.

FIELD OF INVENTION

This invention relates to the field of signal transmission. More specifically, invention relates to a cable for transmission of data and video.

BACKGROUND OF INVENTION

Unshielded twisted pair (UTP) cable is popular for analog and digital data transmission. It consists of a multiplicity of twisted pair wires arranged in a specific grouping—typically four pairs to a jacketed bundle (see FIG. 1A).

FIGS. 1A and 1B illustrate prior art Unshielded Twisted Pair (UTP) cable for data transmission. As illustrated in FIG. 1A, a typical UTP cable 100 comprises four twisted pair wires 104, 106, 108, and 110, all located within a cable bundle. The bundled twisted pair wires are held together with insulation layer 102. Each of the four twisted pairs (e.g. 104, 106, 108 or 110) consists of two wires identified with suffix "A" and "B" and twisted together to form one conductor pair. For example, as illustrated in FIG. 1B, twisted pair conductor 104 comprises wire 104A and wire 104B. Twisted pair 106, twisted pair 108, and twisted pair 110 are also similarly configured.

As illustrated in FIG. 1B, a cross-sectional view of a twisted pair conductor shows two insulated wires in a side-by-side mechanical configuration. In actual practice, the twisted pair rotates the position of the two wires in an intimate helical pattern throughout the traverse of the pair length. Therefore, the twisted pair occupies an overall outer diameter equal to the sum of the diameters of both insulated wires (i.e. shown in dashed lines) even though an instantaneous view shows them to occupy a basically rectangular space.

Twisted pair wires are typically employed to transfer electrical information in the balanced line mode where one wire conveys current in one direction of an alternating current cycle while the second wire of the pair conducts current in the opposite direction of that alternating current cycle; i.e. 180 degrees out of phase. Balanced line operation affords better rejection of outside interference and noise due to normal cancellation in the differential receiver.

From an electrical point-of-view, the basic twisted pair is not shielded (i.e. UTP) and is susceptible to outside interference, crosstalk from other pairs, etc. Further, the magnetic field between the conductors of a twisted pair is concentrated within the aerial region between the two conductors, but is largely considered an external field capable of radiating energy depending on the frequency of operation. A shield can, and often is, added over the twisted pairs at additional cost, size, weight, and complexity. A shielded twisted pair (STP) cable offers distinct advantages over the unshielded variety with minimization of inter-pair crosstalk being one of the greatest advantages. STP cables are finding use in higher speed data applications like Category 7 (10 Gigabit Ethernet) network cabling.

Prior art UTP cable bundles wherein multiple (e.g. 4) twisted pairs are utilized, involve manipulation of the twisted pairs such that each pair has a different twist rate and maintains the same twist rate throughout the cable length so as to minimize crosstalk of data signals between pairs.

For example, each of the prior art twisted pair cables (e.g. 104, 106, 108, or 110) will have a specific twist rate different from the other twisted pairs. All of these twisted pairs, each one made with a specific twist rate, are located side-by-side within the cable bundle. The different twist rates contribute to lowered crosstalk but also contribute to skew (i.e. delay) between the conductor pairs because of the difference in length incident to the different twist rates.

Some prior art technologies employ other means to minimize crosstalk (or coupling). For instance, there are UTP cables constructed such that two pairs of the typically four pairs are twisted in a right-hand direction while the remaining two pairs are twisted in the usual left-hand direction. This configuration further minimizes crosstalk between data signals traveling on the cable pairs.

Twisted pairs are simply made by locating two separate insulated wires in close proximity and then rotating them about one another to create the rolling twist geometry. Twisted pair wire is inexpensive and relatively easy to produce. However, the data networks and many analog applications utilizing twisted pair cable put new demands on twisted pair cable construction. Challenges encountered in making twisted pair cables include: maintenance of a constant twist rate to control intra-pair signal skew; maintenance of a constant, or deliberate, twist rate relationship between pairs in a bundle so as to control pair crosstalk; and control of physical geometry and positioning of the twisted pairs such that cable attenuation characteristics and crosstalk rejection is controlled.

Therefore there is a need for cabling that can be manufactured without the challenges of prior art UTP cable bundles, cheaper than STP cables, and provides benefit similar or better than STP cables, e.g. minimum skew and cross-talk during transmission of data signals.

SUMMARY OF THE INVENTION

The invention is a cable apparatus comprising a mirrored arc geometrical arrangement of two conductors configured to perform similar functions as the traditional twisted pair of wires, and methods of manufacture. The mirrored arc conductor pair of the present invention may occupy the same physical space required by prior art twisted pair cable designs. One or more embodiments of the conductor pair of the present invention includes two inward-facing arc shaped conductors suspended within a dielectric material.

In one or more embodiments, each arc shaped conductor may be constructed from thin foil strips of a conducting metal such as copper, silver, gold, aluminum, or other common metal type.

In one or more embodiments, each arc-shaped conductor may be constructed from a group of separate bare metal conductors (e.g. cylindrically shaped conductors) which are placed side by side in intimate contact so as to effectively create the same mirrored arc geometry.

One or more embodiments of the present invention may include a plurality of diametrically opposed slots in the dielectric material to separate the ends of the arc-shaped conductors. Other embodiments may also include an insulating material between the ends of the arc-shaped conductors.

In one or more embodiments, the mirrored arc conductors of the present invention are bundled to provide similar function as a twisted pair cable bundle of the prior art, without the undesirable artifacts of prior art UTP cables.

Further objects, features, and advantages of the present invention over the prior art will become apparent from the detailed description of the drawings which follows, when considered with the attached figures.

DETAILED DESCRIPTION OF THE INVENTION

The invention discloses a conductor pair for signal transmission, and method for making same. In the following description, numerous specific details are set forth to provide a more thorough description of the present invention. It will be apparent, however, to one skilled in the art, that the present invention may be practiced without these specific details. In other instances, well known features have not been described in detail so as not to obscure the present invention.

Embodiments of the present invention comprise a mirrored arc geometrical arrangement of two conductors configured to perform similar functions as the traditional twisted pair of wires. In one embodiment, a mirrored arc conductor pair occupies the same physical space required by prior art twisted pair cable designs. The mirrored arc configuration of the present invention provides self-shielding without the need for an overall metal shield.

In addition, the size of each insulated conductor of the present invention may be similar to existing twisted pair construction in terms of the insulated diameter. Thus, each insulated conductor, when separated, may be terminated using existing insulation displacement telecommunication connectors, such as RJ45.

Figure 1A:
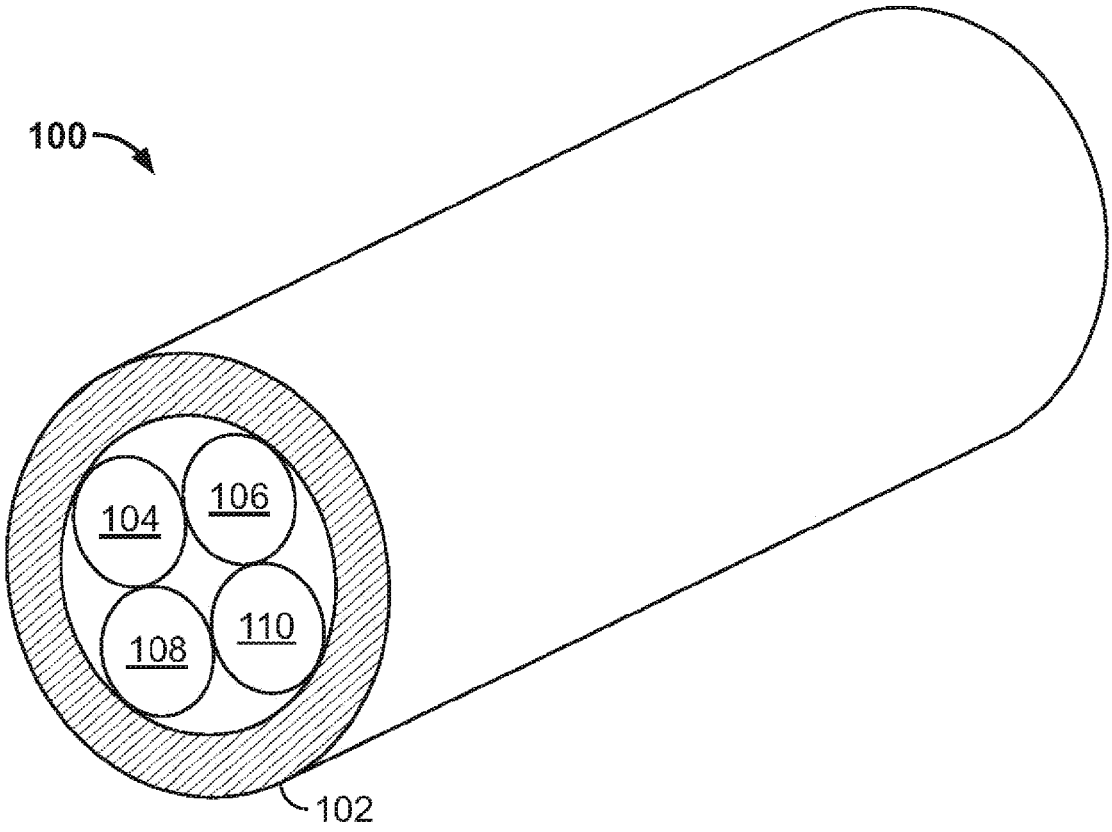
FIG. 1A (Prior Art)
FIG. 1A illustrates prior art Unshielded Twisted Pair (UTP) cable for data transmission.
Figure 1B:
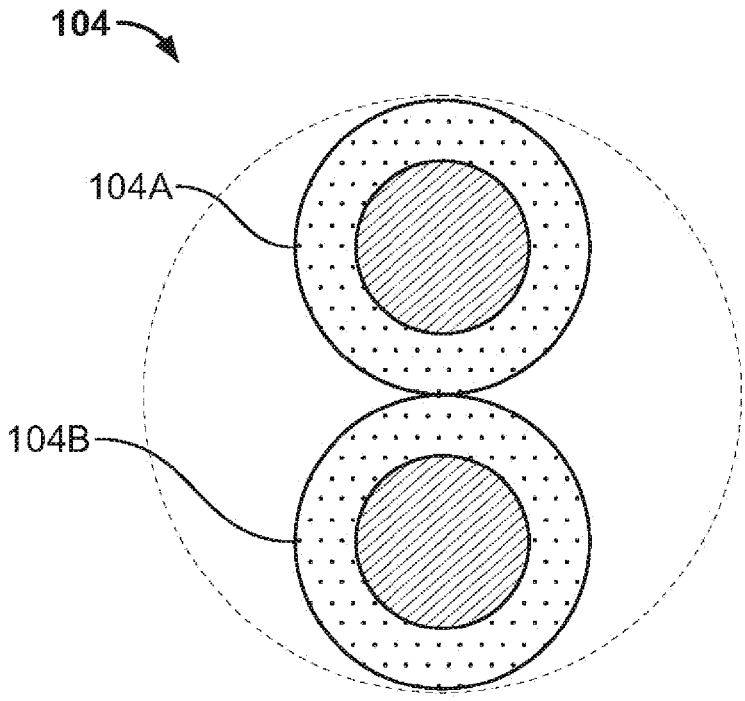
FIG. 1B (Prior Art)
FIG. 1B is a cross-sectional view of a twisted pair conductor 104 showing two insulated wires in a side-by-side mechanical configuration.
Figure 2:
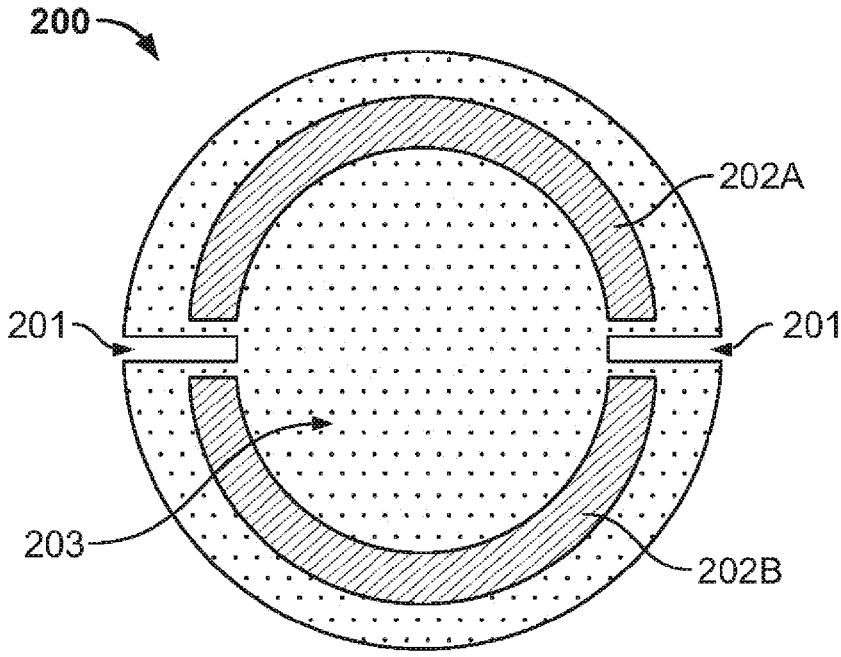
FIG. 2 is an illustration of the cross-section of a mirrored arc conductor pair in accordance with an embodiment of the present invention.

One embodiment of the mirrored arc conductor pair is illustrated in FIG. 2. As illustrated, conductor pair 200 comprises a first arc-shaped and inward facing conductor 202A; a second arc-shaped and inward facing conductor 202B; and insulating material 203. In addition, located in the insulating material 203 and separating the ends of the arc-shaped conductors is a plurality of diametrically opposed slots 201. Each slot 201 may be configured like a key hole which extends approximately to the inside diameter of the inward facing arcs, 202A and 202B.

The two inward-facing arcs (i.e. 202A and 202B) may be created in a variety of ways. For instance, conductor pair 200 may be constructed with thin copper foil strips formed into the opposing arcs. While bare copper is commonly used in the industry as a cost effective, ductile, and practical conductor, any conducting metal such as silver, gold, aluminum, or other common metal type could be used in this invention.

The two conductor strips (i.e. 202A and 202B) are suspended within a dielectric medium (e.g. 203), such as foamed polyethylene. Various types of insulators, in foamed and solid state, could be used to suspend the two conductors. The conductor strips are preferably significantly thinner in cross-section compared to the length. For instance, the ratio of length to thickness may be on the order of about 11:1, 12:1, or any other suitable ratio.

Figure 3:
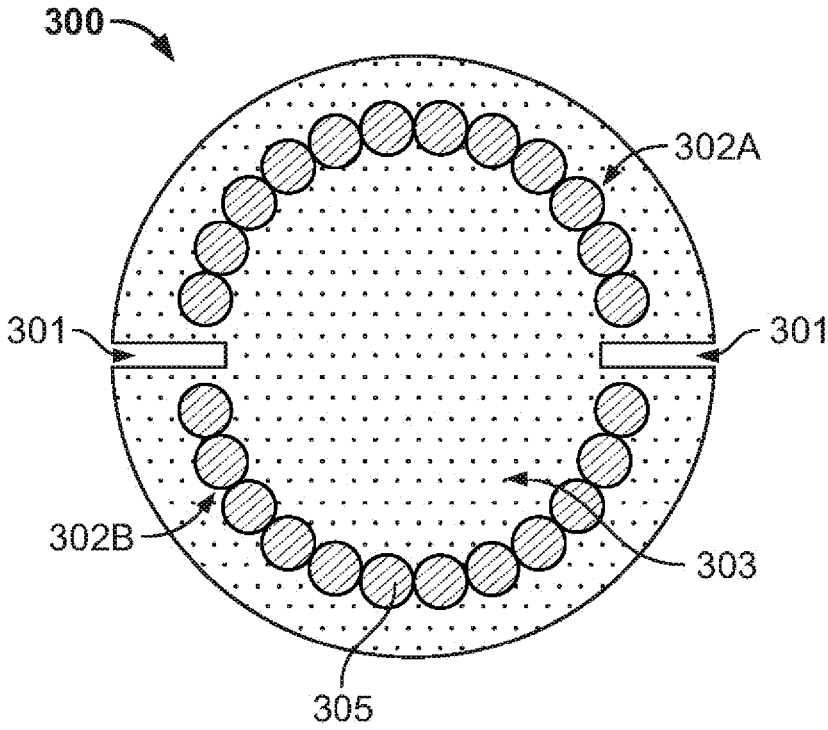
FIG. 3 is an illustration of the cross-section of a mirrored arc conductor pair 300 in accordance with another embodiment of the present invention.

FIG. 3 is an illustration of a mirrored arc conductor pair 300 in accordance with another embodiment of the present invention. As illustrated, conductor pair 300 comprises a first arc-shaped and inward facing conductor 302A; a second arc-shaped and inward facing conductor 302B; and dielectric material 303. In addition, located in the insulating material 303 and separating the ends of the arc-shaped conductors is a plurality of slots 301. Each slot 301 may be configured like a key hole which extends approximately to the inside diameter of the inward facing arcs, 302A and 302B.

Each arc, 302A or 302B, may be formed via a group of separate bare metal conductors (e.g. traditional circular diameter conductors 305) placed side by side in intimate contact so as to effectively create the same mirrored arc geometry. One advantage of this embodiment is simplicity of manufacture with existing machine technology now used to create similar wire relationships such as serve shielding in the cable manufacturing industry.

Figure 4:
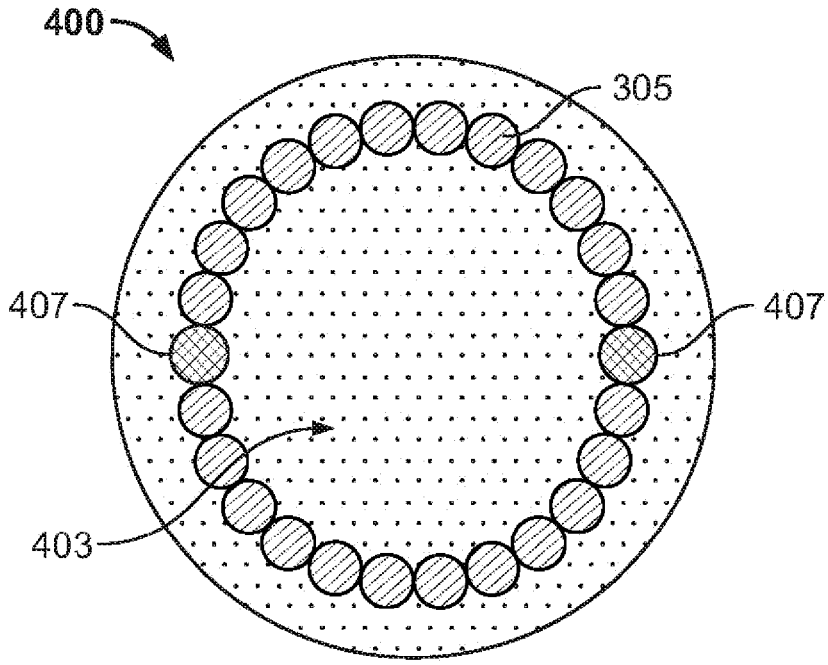
FIG. 4 is an illustration of the cross-section of a mirrored arc conductor pair 400 in accordance with another embodiment of the present invention.

FIG. 4 is an illustration of a mirrored arc conductor pair 400 in accordance with another embodiment of the present invention. As illustrated, the arc-shaped conductors of conductor pair 400 are configured similar to those of FIG. 3 (i.e. 302A and 302B). However, instead of the keyed slots 301, an insulating material 407 (e.g. nylon, polypropylene, polyethylene, etc), which may be shaped similar to the bare metal conductor 305, may be located within the dielectric material 403 to separate the ends of the arc-shaped conductors.

The use of separate, but intimate, bare wires (e.g. 300 and 400) allows for easy helical rotation of the complete assembly as it is extruded. Helical rotation of conductors within wire and cable bundles is a normal process that imparts flexibility to the cable and eases stress when the cable is bent. In addition, manufacturing of the configuration of cable 400 in current helical rotation processes may simply involve replacing two wire bundles, at opposite ends, with two bundles containing insulator material 407.

Manufacturing of the cable of the present invention should be easier than the traditional twisted pair cable because, without the need for a separate twisting operation, only one pass is required to extrude the dielectric around the conductors.

Dielectric loss accounts for most of the degradation to AC (i.e. alternating current) signal performance over any cable length. The dielectric material (e.g. 203, 303, and 403) for embodiments of the present invention may be of solid or foamed materials. Foamed polyethylene (FPE) could be a typical material where the foamed material creates a low loss arrangement for the electrical relationship between the conductors. In a preferred embodiment, foamed dielectric material is used.

Additionally, embodiments of the present invention may also be formed by positioning the same grouping of bare metal conductors around the circumference of a non-conducting core such as a plastic rod or tube; then, adding an outer jacket layer to hold the conductors in place. The core could be solid or hollow. However, the preferred core should provide a mechanical suspension of the conductors so as to maintain the mirrored arc geometry of the invention.

The diametrically opposed indention (e.g. slots 201 and slots 301) into the dielectric of FIGS. 2 and 3 shows a method whereby the orientation of the two conductors may be demarcated after the insulating dielectric is extruded over the conductors. Also, it provides a means to cut and separate the two conductors for termination. The notches (indentions) provide a natural indention for placement of the wire cutter jaws such that the halves of the pair assembly may easily be separated without damage to each conductor. Note that similar, but less deep, indentions may also be included in the embodiment of FIG. 4.

Normally, in manufacturing and application processes, the outside of the pair of conductors have some identifying mark such as a longitudinal stripe or molded rib for the purpose of identifying each conductor uniquely and maintaining consistent polarity when terminating each conductor into a cable assembly. The diametrically opposed indentions of embodiments of the present invention facilitate such identifying marks.

Figure 5:
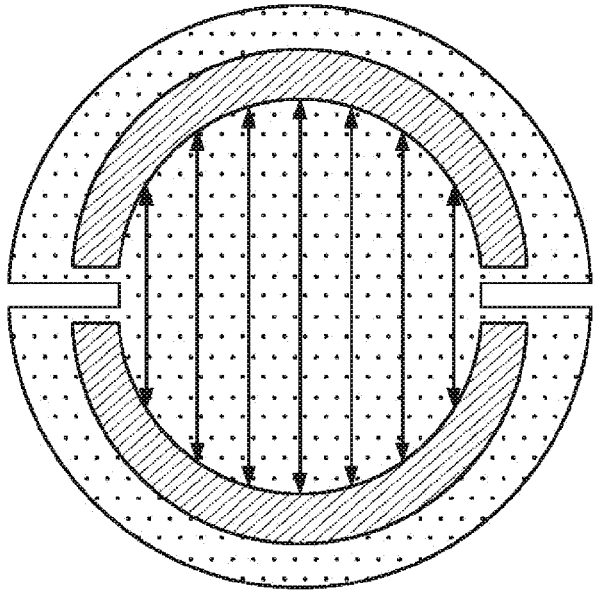
FIG. 5 is an illustration of the magnetic field interaction between the conductors of the present invention.

The conductor pairs of embodiments of the present invention provide self-shielding because of the magnetic field interaction which occurs directly between the internal surfaces of the conductors due to skin effect, as illustrated in FIG. 5. A minimal amount of magnetic egress could be expected from the slot (i.e. notch) on each side of the opposing conductors.

In addition, embodiments of the present invention allow little or no high frequency signal conduction on the exterior surface of either conductor. Therefore, external interference or radio frequencies may conduct along the outer surface without penetrating the primary magnetic/electric field between the conductors. Thus, the conductors of the present invention are suitable for bundling, as illustrated in FIG. 6.

Figure 6:
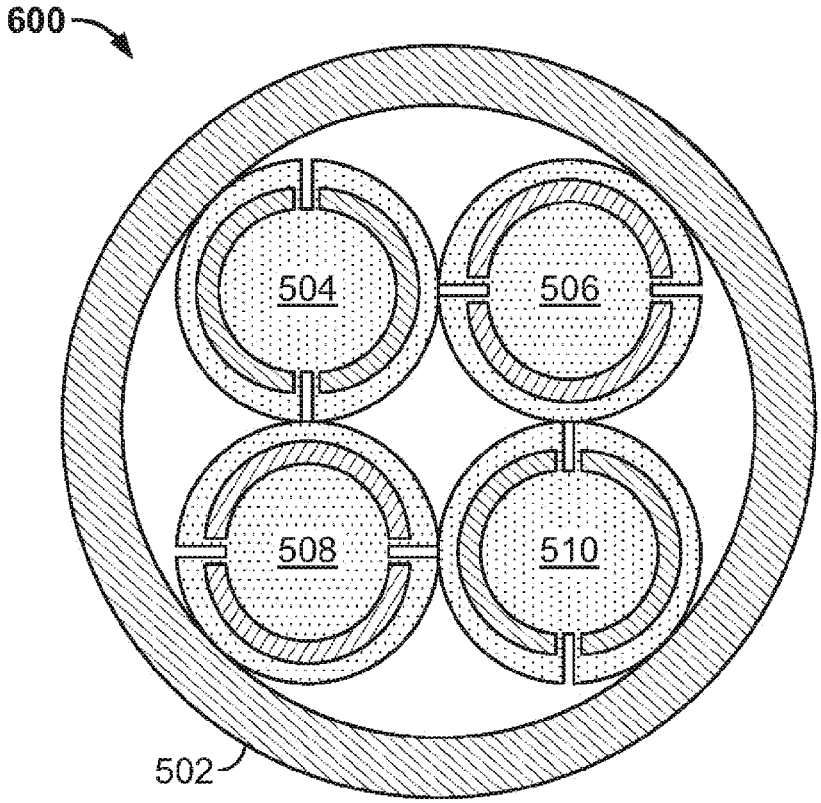
FIG. 6 is an illustration of a cable bundle in accordance with an embodiment of the present invention.

FIG. 6 is an illustration of a cable bundle in accordance with an embodiment of the present invention. In this illustration, a cable bundle having a plurality of conductors is created from a plurality of mirrored arc conductor pair 200 of the present invention. As illustrated, Cable bundle 600 comprises conductor pair 504; conductor pair 506; conductor pair 508; and conductor 510 which are held together with insulation layer 502, which is an outer sleeve or jacket.

Each conductor is arranged in relation to the adjacent conductor pair such that the indentions of adjacent conductors are substantially at right angles to each other. In this configuration, the insignificant magnetic egress from the slot on a conductor pair (e.g. 504), where the slot is in close proximity with an adjacent conductor pair (e.g. 508), will have minimal impact on the performance of the adjacent conductor pair (e.g. 508).

A cable bundle of the present invention, for use as data network cables, should be easier to manufacture than traditional twisted pair cable bundles because there is no need for cables with different twist rates. Thus, it is easy to replicate data network cabling since placement of four of the mirrored arc pairs constitutes the equivalent four-pair data network cable with less concern for mechanical placement.

With embodiments of the present invention, each conductor pair operates similarly as a prior art twisted pair conductor due to the symmetry and consistent internal mechanical arrangement and relationship of conductors. Also, embodiments of the present invention allow for improved control of intra-pair skew since the electrical length of each conductor in a bundle is similar by design. Therefore, eliminating the need for intentional pair length skewing within a data network cable application since embodiments of the present invention minimize crosstalk to a level comparable to an STP cable design.

Also, the mirrored arc conductors of the present invention may be sized so as to provide competitive cross-sectional area to that provided by conventional twisted pair conductors when needed to support the same current carrying capacity in applications where DC power may be conveyed along the pair of conductors as well.

Thus, a novel electronic data transmission cable, and method of making same have been described. It will be understood that the above described arrangements of apparatus and methods are merely illustrative of applications of the principles of this invention and many other embodiments and modifications may be made without departing from the spirit and scope of the invention as defined in the claims.

What is claimed is:

1. A cable comprising:

a non-conducting core;

a first arc-shaped conductor having a first inward facing face suspended around a first partial perimeter of said non-conducting core;

a second arc-shaped conductor having a second inward facing face suspended around a second partial perimeter of said non-conducting core opposite said first partial perimeter to mirror said first arc-shaped conductor, wherein said first inward facing face of said first arc-shaped conductor and said second inward facing face of said second arc-shaped shaped conductor are separated by said non-conducting core; and an outer jacket encompassing said first arc-shaped conductor and said second arc-shaped conductor, wherein said outer jacket comprises a plurality of diametrically opposed slots indicating separation of said first arc-shaped conductor from said second arc-shaped conductor.

2. A cable bundle comprising:

a plurality of mirrored arc cables, each of said mirrored arc cables comprising a pair of inward facing arc-shaped conductors having inward facing faces separated by a non-conducting core; and an outer sleeve encompassing said plurality of mirrored arc conductors, wherein each of said plurality of mirrored arc cables further comprises:

a non-conducting material having two diametrically opposed slots disposed between ends of said pair of inward facing arc-shaped conductors.

3. The cable bundle of claim 2, wherein said plurality of mirrored arc cables are arranged such that said diametrically opposed slots of a first mirrored arc cable is substantially at a right angle to said diametrically opposed slots of an adjacent mirrored arc cable of said plurality of mirrored arc cables.

4. A cable bundle comprising:

a plurality of mirrored arc cables, each of said mirrored arc cables comprising a pair of inward facing arc-shaped conductors having inward facing faces separated by a non-conducting core; and an outer sleeve encompassing said plurality of mirrored arc conductors, wherein each pair of inward facing arc-shaped conductors comprises:

a first arc-shaped conductor suspended around a first partial perimeter of said non-conducting core;

a second arc-shaped conductor suspended around a second partial perimeter of said non-conducting core opposite said first partial perimeter to mirror said first arc-shaped conductor; and an outer jacket encompassing said first arc-shaped conductor and said second arc-shaped conductor, wherein said outer jacket comprises a plurality of diametrically opposed slots.

5. The cable bundle of claim 4, wherein said plurality of mirrored arc cables are arranged such that said diametrically opposed slots of a first mirrored arc cable is substantially at a right angle to said diametrically opposed slots of an adjacent mirrored arc cable of said plurality of mirrored arc cables.

* * * * *